US008135311B2

(12) United States Patent
Tsuda et al.

(10) Patent No.: US 8,135,311 B2
(45) Date of Patent: Mar. 13, 2012

(54) DEVELOPING UNIT HAVING EFFECTIVE DEVELOPER TRANSPORTABILITY, AND PROCESS CARTRIDGE AND IMAGE FORMING APPARATUS USING THE SAME

(75) Inventors: Kiyonori Tsuda, Yokohama (JP); Hiroya Hirose, Sagamihara (JP); Satoru Yoshida, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 811 days.

(21) Appl. No.: 11/836,298

(22) Filed: Aug. 9, 2007

(65) Prior Publication Data

US 2008/0038021 A1 Feb. 14, 2008

(30) Foreign Application Priority Data

Aug. 11, 2006 (JP) ..... 2006-219995

(51) Int. Cl.
*G03G 15/08* (2006.01)
*G03G 15/00* (2006.01)
*G03G 21/16* (2006.01)

(52) U.S. Cl. ..... 399/254; 399/25; 399/111

(58) Field of Classification Search ..... 399/25, 399/254

See application file for complete search history.

(56) References Cited

U.S. PATENT DOCUMENTS 5,659,860 A 8/1997 Sasaki et al.
5,758,241 A 5/1998 Oyama et al.
5,771,426 A 6/1998 Oka et al.
5,771,429 A 6/1998 Oyama et al.
5,805,965 A 9/1998 Tsuda et al.
5,822,664 A 10/1998 Oka et al.
5,915,155 A 6/1999 Shoji et al.
5,963,766 A 10/1999 Okuno et al.
5,999,772 A 12/1999 Kakitani et al.
6,035,168 A * 3/2000 Masuda et al. ..... 399/254
6,198,895 B1 3/2001 Tsuda et al.
6,337,957 B1 1/2002 Tamaki et al.

(Continued)

FOREIGN PATENT DOCUMENTS

JP 4-330470 11/1992

(Continued)

OTHER PUBLICATIONS

Japanese Office Action issued Jul. 8, 2011 for Japanese Patent Application No. 2006-219995, filed Aug. 11, 2006.

(Continued)

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A developing unit includes a developer carrying member, a supplying compartment, a recovery compartment, and an agitation compartment. The developer carrying member develops a latent image formed on an image carrier with a two-component developer. The supplying compartment has a developer supplying transporter to supply the two-component developer to the developer carrying member while transporting the two-component developer. The recovery compartment has a developer recovery transporter to transport the two-component developer recovered from the developer carrying member. The agitation compartment has a developer agitation transporter to agitatingly transports developer. The developer agitation transporter includes a first screw having a screw pitch to transport developer to an upstream end of the supplying compartment from a downstream end of the agitation compartment. The developer supplying transporter includes a second screw having a given screw pitch, which is greater than a screw pitch of the first screw.

17 Claims, 9 Drawing Sheets

U.S. PATENT DOCUMENTS

| | | | | |
|---|---|---|---|---|
| 6,522,855 | B1 | 2/2003 | Katoh et al. | |
| 7,003,255 | B2 | 2/2006 | Kawasumi et al. | |
| 7,024,133 | B2 | 4/2006 | Nagashima et al. | |
| 7,062,207 | B2 | 6/2006 | Tsuda et al. | |
| 7,072,602 | B2 | 7/2006 | Hatori et al. | |
| 7,076,192 | B2 | 7/2006 | Tsuda et al. | |
| 7,110,696 | B2 | 9/2006 | Murakami et al. | |
| 7,136,610 | B2 | 11/2006 | Arai et al. | |
| 7,146,122 | B2 | 12/2006 | Hatori et al. | |
| 7,162,189 | B2 | 1/2007 | Tsuda et al. | |
| 7,184,691 | B2 | 2/2007 | Kita et al. | |
| 7,212,767 | B2 | 5/2007 | Hosokawa et al. | |
| 7,313,348 | B2 * | 12/2007 | Hart et al. | 399/256 |
| 7,426,361 | B2 * | 9/2008 | Thompson et al. | 399/254 |
| 7,463,852 | B2 * | 12/2008 | Yoshida et al. | 399/254 |
| 2002/0051657 | A1 | 5/2002 | Yuuki et al. | |
| 2004/0223790 | A1 | 11/2004 | Hosokawa et al. | |
| 2005/0226656 | A1 | 10/2005 | Tsuda et al. | |
| 2006/0045573 | A1 | 3/2006 | Yamaguchi et al. | |
| 2006/0051136 | A1 | 3/2006 | Tsuda et al. | |
| 2006/0083555 | A1 | 4/2006 | Uchiyama et al. | |
| 2006/0204283 | A1 * | 9/2006 | Yasuda | 399/254 |
| 2006/0216063 | A1 * | 9/2006 | Okoshi | 399/111 |
| 2006/0216067 | A1 * | 9/2006 | Okoshi | 399/258 |
| 2006/0216085 | A1 | 9/2006 | Murakami et al. | |
| 2007/0025773 | A1 * | 2/2007 | Tateyama et al. | 399/254 |
| 2007/0081835 | A1 | 4/2007 | Tsuda et al. | |
| 2007/0116494 | A1 | 5/2007 | Uno et al. | |
| 2007/0122202 | A1 * | 5/2007 | Taguma et al. | 399/254 |
| 2007/0140747 | A1 | 6/2007 | Kita et al. | |
| 2007/0160392 | A1 | 7/2007 | Tsuda et al. | |
| 2007/0264054 | A1 * | 11/2007 | Tsuda et al. | 399/256 |
| 2008/0253810 | A1 * | 10/2008 | Tateyama et al. | 399/258 |
| 2008/0267668 | A1 * | 10/2008 | Sakata et al. | 399/254 |
| 2008/0317508 | A1 * | 12/2008 | Terai et al. | 399/254 |
| 2009/0016777 | A1 * | 1/2009 | Miyamoto et al. | 399/238 |
| 2009/0087214 | A1 * | 4/2009 | Utsunomiya et al. | 399/103 |
| 2009/0103951 | A1 * | 4/2009 | Tsuda | 399/254 |

FOREIGN PATENT DOCUMENTS

| | | |
|---|---|---|
| JP | 11-167260 | 6/1999 |
| JP | 2001-249545 | 9/2001 |
| JP | 2001-255723 | 9/2001 |
| JP | 2002-139901 | 5/2002 |
| JP | 2003-122124 | 4/2003 |
| JP | 2004-77587 | 3/2004 |
| JP | 2004-233597 | 8/2004 |
| JP | 2004-258237 | 9/2004 |
| JP | 2006-30276 | 2/2006 |

OTHER PUBLICATIONS

Japanese Office Action dated Oct. 14, 2011, issued for Japanese Patent Application No. 2006-219995, dispatch No. 687518.

* cited by examiner

DEVELOPING UNIT HAVING EFFECTIVE DEVELOPER TRANSPORTABILITY, AND PROCESS CARTRIDGE AND IMAGE FORMING APPARATUS USING THE SAME

TECHNICAL FIELD

The present disclosure relates generally to a developing unit for use in an image forming apparatus, and more particularly, to a developing unit using two-component developer having toner and carrier, and a process cartridge and an image forming apparatus using such developing unit.

DESCRIPTION OF BACKGROUND ART

Conventionally, a developing unit using two-component developer may have a developer carrying member, a supplying compartment, and an agitation compartment, for example.

Developer transported in the supplying compartment may be supplied to the developer carrying member, and agitatingly transported in the agitation compartment.

Such developer may be circulated between the supplying compartment and the agitation compartment, wherein developer may be transported in opposite directions in each compartment.

In such developing unit, the developer carrying member may use some developer and consume some toner at a developing area of the developer carrying member for a developing process, and then used developer may be recovered in the supplying compartment.

Accordingly, such used developer, which consumed toner, may be mixed with un-used developer transported in the supplying compartment. Such un-used developer may mean developer transported in the supplying compartment but not be carried up to the developer carrying member.

The supplying compartment and the developer carrying member may have substantially identical lengths and be disposed parallel to each other. In other words, the supplying compartment may extend along an axial length of the developer carrying member.

Such supplying compartment may have an upstream side and a downstream side defined in terms of a direction of transport of developer in the supplying compartment.

In such supplying compartment, an amount of used developer, which passes over the developing area on the developer carrying member and is recovered in the supplying compartment, may increase toward the downstream side of the transport direction in the supplying compartment.

Accordingly, toner concentration in the developer, transported in the supplying compartment, may decrease toward the downstream side of the transport direction in the supplying compartment because toner was consumed at the developing area for the image developing process as described above.

Such decrease of toner concentration in the developer may cause uneven toner concentration along the axial length of the developer carrying member. Specifically, the developer carrying member has a given length in its axial direction, and therefore toner concentration on the developer carrying member at the upstream side of the transport direction may become greater than toner concentration on the developer carrying member at the downstream side.

Such uneven toner concentration on the developer carrying member may result in uneven image concentration on a recording sheet.

In another configuration, used developer may be recovered in the agitation compartment. In such case, the recovered developer in the agitation compartment may be agitated for a length of time that varies depending on a recovery position of developer in the agitation compartment.

For example, toward the downstream side of transport direction in the agitation compartment, recovered developer may be agitated for a shorter time.

In general, an end portion on the downstream side of transport direction of the agitation compartment may communicate with an end portion on the upstream side of transport direction of the supplying compartment.

Accordingly, developer recovered at the downstream side of transport direction of the agitation compartment may be supplied to the supplying compartment within a relatively shorter period of time, which may cause uneven agitation of the recovered developer in the agitation compartment. As a result, the toner may be charged unevenly even if fresh toner is used to refill the developing unit, which may adversely affect image quality and result in uneven and/or decreased image concentration on the recording sheet.

The above-mentioned drawback may occur due to a recovery configuration using a supplying compartment or an agitation compartment to recover developer.

In one conventional example, a developing unit may have a recovery compartment in addition to a supplying compartment and an agitation compartment to cope with such drawback. The recovery compartment may be used to recover used developer in the developing unit.

The supplying compartment may be used to supply developer to a developer carrying member while transporting the developer in the supplying compartment.

The recovery compartment may be used to recover developer and transport the recovered developer in a direction parallel to a developer transport direction of the supplying compartment.

The agitation compartment may be used to agitate excess developer, transported to a downstream side of the transport direction of the supplying compartment, with the recovered developer transported to a downstream side of transport direction of the recovery compartment.

Such supplying compartment, recovery compartment, and agitation compartment may be separated from each other by separation walls.

A first separation wall, set between the agitation compartment and the supplying compartment, may have an opening port through which agitated developer may be transferred from the downstream side of the agitation compartment to the upstream side of the supplying compartment.

The first separation wall, set between the supplying compartment and the agitation compartment, may have another opening port, through which excess developer may be transferred from the downstream side of the supplying compartment to the upstream side of the agitation compartment. Excess developer may mean developer transported in the supplying compartment but not carried up to the developer carrying member.

A second separation wall, set between the recovery compartment and the agitation compartment, may have an opening port, through which recovered developer may be transferred from the downstream side of the recovery compartment to the upstream side of the agitation compartment.

In such configuration, a supply of developer to the developer carrying member and a recovery of developer from the developer carrying member may be conducted separately, by which a toner concentration in developer to be supplied to the developer carrying member may become uniform along an axial length of the developer carrying member. Accordingly, image concentration may become uniform.

Furthermore, in such configuration, an agitation of developer and a recovery of developer may be conducted separately, by which the developer may be agitated effectively. Accordingly, image concentration may become stabilized.

In such developing unit, the agitation compartment may have an agitation screw as an agitating and transporting member. Such agitation screw may agitatingly transport developer in the agitation compartment, and supply developer to an upstream side of the supplying compartment from a downstream side of the agitation compartment.

If the supplying compartment is disposed above the agitation compartment, the agitation screw may need some developer transport force to transport developer from a lower side to an upper side against the force of gravity.

Accordingly, such agitation screw may be manufactured with a given condition based on several factors such as screw pitch and screw rotation speed, so that the agitation screw can provide a developer transport force for transporting developer at the downstream side of the agitation compartment.

Specifically, the agitation screw may have a relatively short screw pitch and a screw vane disposed at an angle closer to 90 degrees, so that developer can be pushed upward from the downstream side of agitation compartment to the upstream side of supplying compartment.

If the agitation screw has a relatively long screw pitch and a screw vane disposed at an angle closer to 0 degrees, the developer may not be effectively pushed upward with the screw vane. Accordingly, the agitation screw may not provide the developer transport force necessary for transporting developer at the downstream side of the agitation compartment. Therefore, the developer may not be effectively transported to the upstream side of supplying compartment.

Further, the agitation screw may have a given screw rotation speed such that the developer may be effectively supplied to the upstream side of supplying compartment from the downstream side of the agitation compartment when the agitation screw has a relatively shorter screw pitch.

In general, a screw manufactured with a same given screw pitch, a same given outer diameter, and a same given rotational speed may be used in the above-mentioned compartments from a viewpoint of manufacturing cost.

However, if an image forming apparatus conducts image forming operations with a higher speed, developer may not be effectively transported to the downstream side of supplying compartment, which may result in insufficient image concentration corresponding to the downstream side of the supplying compartment, which is undesirable.

In such higher speed image forming process, an amount of developer to be supplied to the developer carrying member per unit time may need to be increased. In that case, although the developer may be effectively supplied from the agitation compartment to the upstream side of supplying compartment, an amount of developer to be transported to the downstream side of the supplying compartment by a supplying screw may be insufficient for an amount of developer to be supplied to the developer carrying member.

Therefore, at the downstream side of the supplying compartment, the developer may not be sufficiently supplied to the developer carrying member, and the resultant formed image may not have sufficient image concentration.

Screw rotation speed may be increased to cope with the above-mentioned insufficient supply of the developer at the downstream side of supplying compartment. However, such increased speed may adversely affect durability and generate heat at a shaft bearing of the screw.

In addition, an outer diameter of the screw may be increased to cope with the above-mentioned insufficient supply of the developer at the downstream side of supplying compartment. However, such an increase in the diameter of the screw may hinder efforts to make the developing unit more compact.

SUMMARY

The present disclosure relates to a developing unit having a developer carrying member, a supplying compartment, a recovery compartment, and an agitation compartment. The developer carrying member develops a latent image formed on an image carrier with a two-component developer having toner and magnetic carrier by supplying toner to a surface of the image carrier. The supplying compartment has a developer supplying transporter to supply the two-component developer to the developer carrying member while transporting the two-component developer in an axial direction of the developer carrying member. The recovery compartment has a developer recovery transporter to transport the two-component developer recovered from the developer carrying member in an axial direction of the developer recovery transporter. The developer recovery transporter transports the recovered developer in a same direction of the developer supplying transporter. The agitation compartment has a developer agitation transporter to agitate an excess developer, which is not used for a developing process and transported to a downstream side in the supplying compartment and transported to the agitation compartment from the supplying compartment, and the recovered developer transported to the agitation compartment from the recovery compartment. The developer agitation transporter transports the agitated excess developer and recovered developer in an axial direction of the developer agitation transporter, which is an opposite direction of the developer supplying transporter. The agitated excess developer and recovered developer is to be transported to the supplying compartment. The recovery compartment, the supplying compartment, and the agitation compartment are each separated from one another by one or more separation members, and a toner is refilled to a developer transport route formed of the recovery compartment, the supplying compartment, and the agitation compartment. The developer agitation transporter includes a first screw having a given screw pitch to transport a given amount developer to an upstream end of the supplying compartment from a downstream end of the agitation compartment. The developer supplying transporter includes a second screw having a given screw pitch greater than a screw pitch of the first screw.

The present disclosure also relates to a process cartridge detachable from an image forming apparatus. The process cartridge includes a developing unit, and at least one of an image carrier, a charging unit and a cleaning unit. The at least one of the image carrier, charging unit, and cleaning unit is integrally assembled with the developing unit. The developing unit has a developer carrying member, a supplying compartment, a recovery compartment, and an agitation compartment. The developer carrying member develops a latent image formed on an image carrier with a two-component developer having toner and magnetic carrier by supplying toner to a surface of the image carrier. The supplying compartment has a developer supplying transporter to supply the two-component developer to the developer carrying member while transporting the two-component developer in an axial direction of the developer carrying member. The recovery compartment has a developer recovery transporter to transport the two-component developer recovered from the developer carrying member in an axial direction of the developer recovery transporter. The developer recovery transporter transports the recovered developer in a same direction of the developer supplying transporter. The agitation compartment has a developer agitation transporter to agitate an excess developer, which is not used for a developing process and transported to a downstream side in the supplying compartment and transported to the agitation compartment from the supplying compartment, and the recovered developer transported to the agitation compartment from the recovery compartment. The developer agitation transporter transports the agitated excess developer and recovered developer in an axial direction of the developer agitation transporter, which is an opposite direction of the developer supplying transporter. The agitated excess developer and recovered developer is to be transported to the supplying compartment. The recovery compartment, the supplying compartment, and the agitation compartment are each separated from one another by one or more separation members, and a toner is refilled to a developer transport route formed of the recovery compartment, the supplying compartment, and the agitation compartment. The developer agitation transporter includes a first screw having a given screw pitch to transport a given amount developer to an upstream end of the supplying compartment from a downstream end of the agitation compartment. The developer supplying transporter includes a second screw having a given screw pitch greater than a screw pitch of the first screw.

The present disclosure also relates to an image forming apparatus having an image carrier, a developing unit. The image carrier carries a latent image. The developing unit develops the latent image as toner image. The developing unit has a developer carrying member, a supplying compartment, a recovery compartment, and an agitation compartment. The developer carrying member develops a latent image formed on an image carrier with a two-component developer having toner and magnetic carrier by supplying toner to a surface of the image carrier. The supplying compartment has a developer supplying transporter to supply the two-component developer to the developer carrying member while transporting the two-component developer in an axial direction of the developer carrying member. The recovery compartment has a developer recovery transporter to transport the two-component developer recovered from the developer carrying member in an axial direction of the developer recovery transporter. The developer recovery transporter transports the recovered developer in a same direction of the developer supplying transporter. The agitation compartment has a developer agitation transporter to agitate an excess developer, which is not used for a developing process and transported to a downstream side in the supplying compartment and transported to the agitation compartment from the supplying compartment, and the recovered developer transported to the agitation compartment from the recovery compartment. The developer agitation transporter transports the agitated excess developer and recovered developer in an axial direction of the developer agitation transporter, which is an opposite direction of the developer supplying transporter. The agitated excess developer and recovered developer is to be transported to the supplying compartment. The recovery compartment, the supplying compartment, and the agitation compartment are each separated from one another by one or more separation members, and a toner is refilled to a developer transport route formed of the recovery compartment, the supplying compartment, and the agitation compartment. The developer agitation transporter includes a first screw having a given screw pitch to transport a given amount developer to an upstream end of the supplying compartment from a downstream end of the agitation compartment. The developer supplying transporter includes a second screw having a given screw pitch greater than a screw pitch of the first screw.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
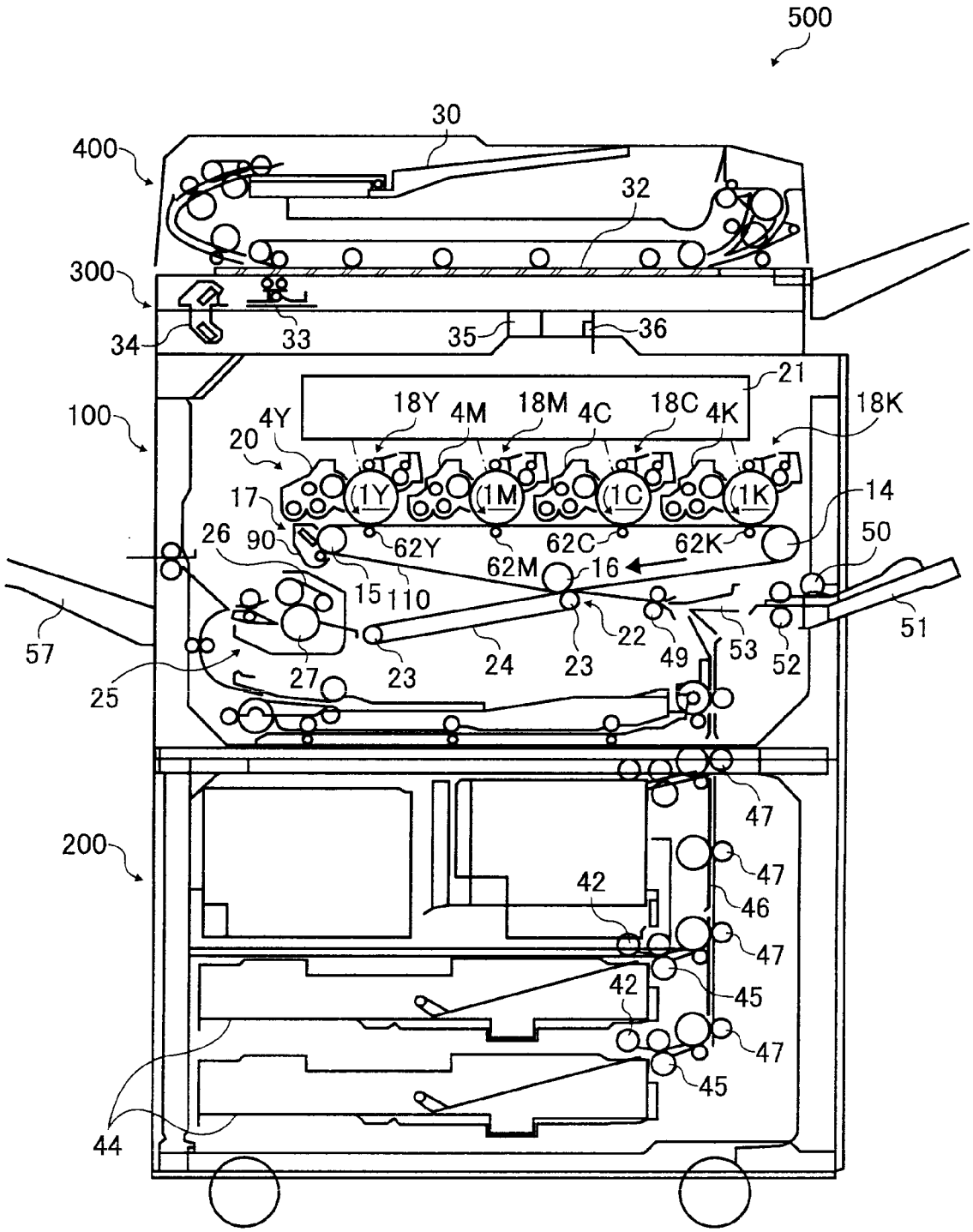
FIG. 1 is a schematic configuration of an image forming apparatus according to an example embodiment.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there is no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 2:
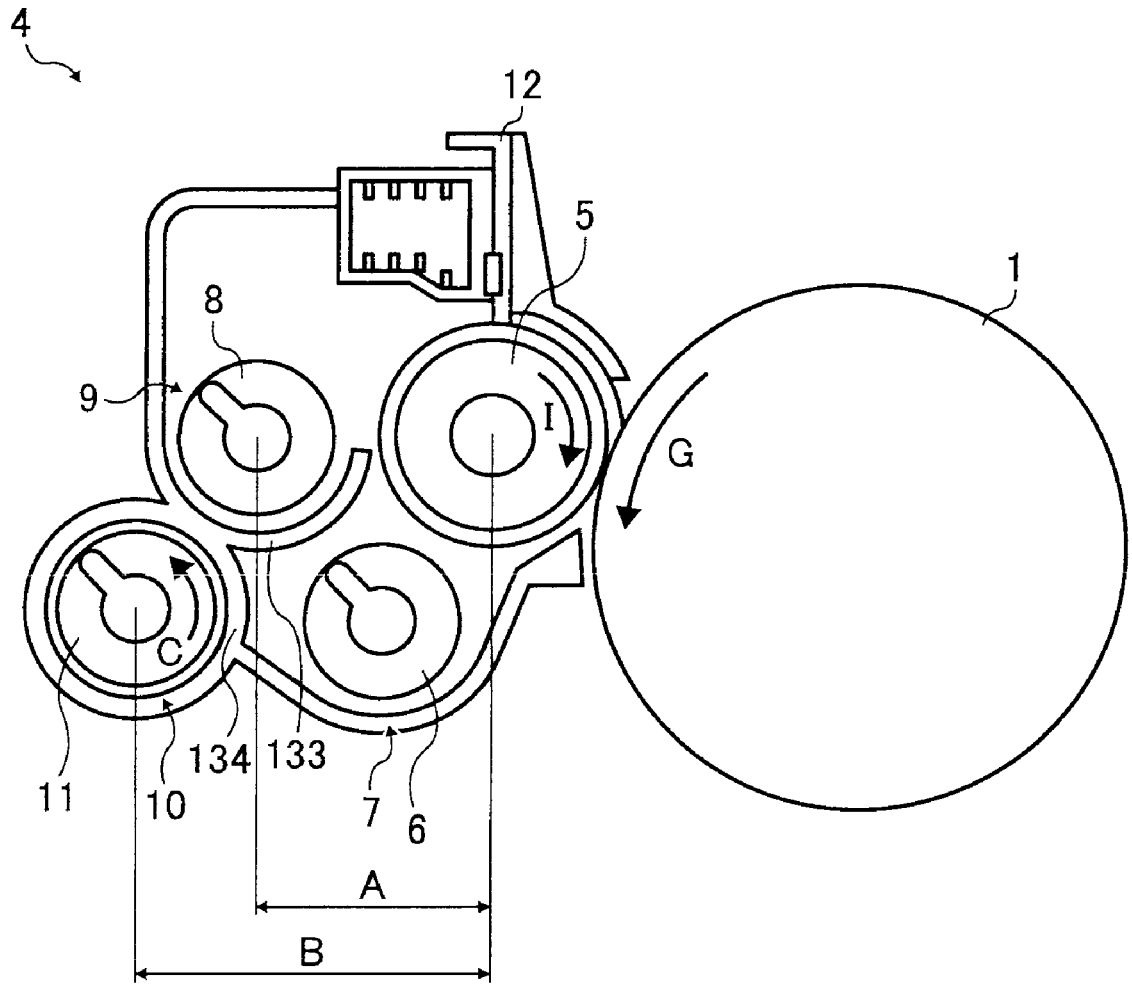
FIG. 2 is a schematic configuration of a developing unit and a photoconductor of an image forming apparatus according to an example embodiment.

Referring now to the drawings, wherein like reference numerals designate identical or corresponding parts throughout the several views, an image forming apparatus according to an example embodiment is described with particular reference to FIGS. 1 and 2.

Hereinafter, an image forming apparatus 500 according to an example embodiment is explained with reference to FIG. 1. The image forming apparatus 500 may include a color laser copier having a plurality of photoconductors arranged in a tandem manner, for example, but not be limited such apparatus.

FIG. 1 shows a schematic configuration of the image forming apparatus 500. The image forming apparatus 500 may include a printing unit 100, a sheet feed unit 200, a scanner 300, and an automatic document feeder (ADF) 400, for example.

The printing unit 100 may be placed over the sheet feed unit 200, the scanner 300 may be placed on the printing unit 100, and the ADF 400 may be placed on the scanner 300, for example.

The printing unit 100 may include an image forming unit 20, which may include process cartridges 18Y, 18M, 18C, and 18K for forming images of yellow(Y), magenta(M), cyan(C), and black(K), respectively. Hereinafter, Y, M, C, and K may represent yellow, cyan, magenta, and black, respectively.

The printing unit 100 may further include an optical writing unit 21, an intermediate transfer unit 17, a secondary transfer unit 22, registration rollers 49, and a fixing unit 25 (e.g., belt type), for example.

The optical writing unit 21 may include a light source, polygon mirror, f-theta lens, and reflection mirror (not shown), for example. The optical writing unit 21 may irradiate a laser beam on a surface of photoconductor (to be described later) based on image data.

Each of the process cartridges 18Y, 18M, 18C, and 18K may include a photoconductor 1 in drum shape, a charging unit, a developing unit 4, a drum cleaning unit, and a de-charging unit, for example.

Because the process cartridges 18Y, 18M, 18C, and 18K may have a similar configuration one another, the process cartridge 18Y is used for explaining an image forming operation hereinafter.

The charging unit may uniformly charge a surface of photoconductor 1Y of the process cartridge 18Y.

The optical writing unit 21 may irradiate a laser beam onto the charged surface of the photoconductor 1Y. An area irradiated by the laser beam may have a potential, which may be lower than an area not irradiated by the laser beam, by which an electrostatic latent image for Y-image may be formed on the surface of the photoconductor 1Y.

Such electrostatic latent image may be developed by the developing unit 4Y as Y toner image.

Such Y toner image formed on the photoconductor 1Y may be primary transferred to an intermediate transfer belt 110, to be described later.

After primary transferring toner image, the drum cleaning unit may clean toners remaining on the surface of the photoconductor 1Y, and then the photoconductor 1Y may be de-charged by the de-charging unit, by which the photoconductor 1Y may be ready for another image forming operation.

Other process cartridges 18M, 18C, and 18K may be operated in a similar manner.

Hereinafter, the intermediate transfer unit 17 is explained. The intermediate transfer unit 17 may include an intermediate transfer belt 110, a belt cleaning unit 90, a tension roller 14, a drive roller 15, a secondary-transfer backup roller 16, and primary transfer bias rollers 62Y, 62M, 62C, and 62K, for example.

The intermediate transfer belt 110 may be extended by a plurality of rollers including the tension roller 14. The intermediate transfer belt 110 may travel in a clockwise direction in FIG. 1 with a rotation of the drive roller 15 driven by a belt drive motor (not shown).

The primary transfer bias rollers 62Y, 62M, 62C, and 62K may contact an inner surface of the intermediate transfer belt 110, and may receive a primary transfer bias voltage from a power source (not shown).

Each of the primary transfer bias rollers 62Y, 62M, 62C, and 62K may form a primary transfer nip with the respective photoconductors 1Y, 1M, 1C, and 1K by pressing the intermediate transfer belt 110.

At each primary transfer nip, a primary transfer electric field may be formed between the photoconductor 1 and primary transfer bias roller 62 with an effect of the primary transfer bias voltage.

The Y toner image formed on the photoconductor 1Y may be primary transferred onto the intermediate transfer belt 110 with an effect of the primary transfer electric field and nip pressure.

Other M, C, and K toner images formed on the photoconductor 1M, 1C, and 1K may be sequentially superimposed on the Y toner image at respective primary transfer nip.

With such primary transfer process, the intermediate transfer belt 110 may have a four-color toner image thereon.

Such four-color toner image on the intermediate transfer belt 110 may be secondary transferred to a recording sheet (not shown) at a secondary transfer nip, to be described later.

After secondary transferring toner image to the recording sheet, toners remaining on the intermediate transfer belt 110 may be cleaned by the belt cleaning unit 90, which may sandwich the intermediate transfer belt 110 with the drive roller 15.

Hereinafter, the secondary transfer unit 22 is explained. As shown in FIG. 1, a sheet transport belt 24 extended by two tension rollers 23 may be disposed under the intermediate transfer unit 17.

The sheet transport belt 24 may travel in a counter-clockwise direction in FIG. 1 with a rotation of tension roller 23.

As shown in FIG. 1, one tension roller 23 and the secondary-transfer backup roller 16 may sandwich the intermediate transfer belt 110 and sheet transport belt 24.

With such sandwiching, a secondary transfer nip may be formed, at which the intermediate transfer belt 110 of the intermediate transfer unit 17 and the sheet transport belt 24 of the secondary transfer unit 22 may contact each other.

Such one tension roller 23 may receive a secondary transfer bias voltage, having an opposite polarity of toners, from a power source (not shown).

With such secondary transfer bias voltage, a secondary transfer electric field may be formed at the secondary transfer nip, by which four-color toner image on the intermediate transfer belt 110 may be transferred toward the one tension roller 23.

To such secondary transfer nip, registration rollers 49, to be described later, may feed a recording sheet at a given timing, which is synchronized with a timing of forming four-color toner image on the intermediate transfer belt 110.

The four-color toner image may be secondary transferred on the recording sheet with an effect of the secondary transfer electric field and nip pressure.

The recording sheet may be charged by the tension roller 23 as such, or may be charged by a non-contact type charger.

The sheet feed unit 200 may include a plurality of sheet cassettes 44, which may be disposed in a vertical direction as shown FIG. 1. The sheet cassette 44 may store a plurality of recording sheets.

The top recording sheet of the sheet cassette 44 may be pressed to a feed roller 42. With a rotation of the feed roller 42, the top recording sheet may be fed to a sheet transport route 46.

The sheet transport route 46 may include a plurality of transport rollers 47, and the registration rollers 49 at the end of sheet transport route 46, for example.

The recording sheet may be transported to the registration rollers 49 in the sheet transport route 46, and may be sandwiched by the registration rollers 49.

The four-color toner image formed on the intermediate transfer belt 110 in the intermediate transfer unit 17 may be transported to the secondary transfer nip with a traveling of intermediate transfer belt 110.

The registration rollers 49 may feed the recording sheet to the secondary transfer nip at a given timing, at which four-color toner image may be transferred onto the recording sheet from the intermediate transfer belt 110. Accordingly, a full-color image may be formed on the recording sheet.

The recording sheet having the full-color image may be transported to the fixing unit 25 with a traveling of the sheet transport belt 24.

The fixing unit 25 may include a fixing belt 26, and a pressure roller 27, for example.

The fixing belt 26, extended by two rollers, may be pressed by the pressure roller 27.

The fixing belt 26 and pressure roller 27 may form a fixing nip therebetween. The recording sheet, transported by the sheet transport belt 24, may be sandwiched by the fixing belt 26 and pressure roller 27 at the fixing nip.

One of the two rollers extending the fixing belt 26 may include a heat source (not shown) to heat the fixing belt 26.

The fixing belt 26 and the pressure roller 27 may apply heat and pressure to the recording sheet at the fixing nip to fix the full color image on the recording sheet.

After such fixing process in the fixing unit 25, the recording sheet may be stacked on a tray 57, provided on a side of the image forming apparatus 500.

Furthermore, the recording sheet may be transported to the secondary transfer nip again to form a toner image on another face of the recording sheet.

When to copy document sheets (not shown), such document sheets may be set on a document tray 30 of the ADF 400.

If document cannot be set on the document tray 30 of the ADF 400, such document may be directly placed on a contact glass 32 of the scanner 300 by opening the ADF 400. Such placed document may be closely contacted to the contact glass 32 by closing the ADF 400.

After setting the document as such, a start button (not shown) may be pressed to start a document scanning operation by the scanner 300.

When document sheets are set on the ADF 400, the ADF 400 may automatically feed the document sheets to the contact glass 32 for document scanning operation. The document scanning operation may be conducted as below.

The scanner 300 may include a first carriage 33 and a second carriage 34, which may move simultaneously during the document scanning operation.

The first carriage 33 may include a light source, which may emit a light to a document face placed on the contact glass 32.

A reflection light from the document face may be reflected by a mirror in the second carriage 34, then pass through a focus lens 35, and enter on a scanning sensor 36. The scanning sensor 36 may configure image data based on such light.

During such document scanning operation, other units or devices such as process cartridges 18Y, 18M, 18C, 18K, intermediate transfer unit 17, secondary transfer unit 22, and fixing unit 25 may be activated.

Based on the image data configured by the scanning sensor 36, the optical writing unit 21 may be driven to write a latent image on the photoconductors 1Y, 1M, 1C, and 1K, and then such latent image may be developed as Y, M, C, and K toner image.

Such toner images may be superimposingly transferred on the intermediate transfer belt 110 as four-color toner image.

During the document scanning operation, the sheet feed unit 200 may be activated for sheet feed operation.

During the sheet feed operation, the feed roller 42 may feed recording sheets stacked in the sheet cassette 44.

A separation roller 45 may separate and feed recording sheets one by one to the sheet transport route 46, and then the recording sheets may be transported to the secondary transfer nip by a transport roller 47.

Further, recording sheets can be fed from a manual feed tray 51, as required. A feed roller 50 may feed recording sheets from the manual feed tray 51 to a separation roller 52 one by one. Then, the recording sheet may be fed to a feed route 53 in the printing unit 100.

When forming an multi-color image with the image forming apparatus 500, the intermediate transfer belt 110 may be extended in a horizontal direction and may contact each of the photoconductors 1Y, 1M, 1C, and 1K.

When forming a monochrome image with K toner of the image forming apparatus 500, the intermediate transfer belt 110 may be slanted from a horizontal direction with a slanting mechanism (not shown) to discontact the intermediate transfer belt 110 from the photoconductors 1Y, 1M, and 1C. The photoconductor 1K may be rotated in a counter-clockwise direction to form a K toner image on the photoconductor 1K.

During such monochrome image forming operation, photoconductors and developing units for Y, M, C may be deactivated so that the photoconductors and developer for Y, M, C may not be wastefully used or activated.

The image forming apparatus 500 may further include a controlling unit (not shown) and a display unit (not shown).

The controlling unit may include a CPU (central processing unit) to control devices in the image forming apparatus 500, and the display unit may include a liquid crystal display, keys and buttons, or the like, for example.

An operator can send an instruction to the controlling unit with inputting information via the display unit. For example, an operator can select a mode for one-face printing operation, which forms an image on one face of recording sheet.

FIG. 2 shows an expanded view of the developing unit 4 and photoconductor 1 used in the process cartridges 18Y, 18M, 18C, and 18K. Because the process cartridges 18Y, 18M, 18C, and 18K may have similar configuration one another except toner color, suffix of Y, M, C, K may be omitted in FIG. 2.

The surface of photoconductor 1, rotating in a direction shown by an arrow G, may be charged by a charging unit (not shown).

The optical writing unit 21 may irradiate the charged surface of photoconductor 1 with a laser beam to write an electrostatic latent image on the photoconductor 1. The developing unit 4 may develop such latent image as toner image.

The developing unit 4 may include a developing roller 5 as shown in FIG. 2.

The developing roller 5 may rotate in a direction shown by an arrow I in FIG. 2 to supply toner to a latent image formed on the surface of the photoconductor 1 to develop the latent image as toner image.

The developing unit 4 may also include a supply screw 8, which may transport developer in one direction while supplying developer to the developing roller 5.

The developing unit 4 may also include a doctor blade 12 for regulating a thickness of developer supplied on the developing roller 5. The doctor blade 12 may regulate a thickness of developer on the developing roller 5 at a preferable level for developing process.

The developing unit 4 may also include a recovery screw 6 to recover developer, which is used for developing process, and to transport the recovered developer in a direction, which is a same transport direction of supply screw 8.

The developing unit 4 may also include a supplying compartment 9, and a recovery compartment 7.

The supplying compartment 9 including the supply screw 8 may be positioned at a side direction with respect to the developing roller 5, and the recovery compartment 7 including the recovery screw 6 may be positioned at a lower side direction with respect to the developing roller 5.

The developing unit 4 may also include an agitation compartment 10, which is positioned under the supplying compartment 9 and side-by-side of the recovery compartment 7.

The agitation compartment 10 may include an agitation screw 11, which agitatingly transports the developer in a direction, opposite to the transport direction of the supply screw 8.

The developing unit 4 may also include a first separation wall 133, which may separate the supplying compartment 9 and agitation compartment 10.

The first separation wall 133 may have an opening port on each end portion of first separation wall 133. The supplying compartment 9 and agitation compartment 10 may be communicated each other through such opening ports.

The supplying compartment 9 and recovery compartment 7 may also be separated by the first separation wall 133, but the first separation wall 133 has no opening ports between the supplying compartment 9 and recovery compartment 7.

The developing unit 4 may also include a second separation wall 134, which may separate the agitation compartment 10 and recovery compartment 7.

The second separation wall 134 may have one opening port at one end portion of the second separation wall 134. The agitation compartment 10 and recovery compartment 7 may communicate each other through such one opening port.

The above-mentioned supply screw 8, recovery screw 6, and agitation screw 11 may be made of resin material or metal material, for example.

The developing roller 5 may carry and transport developer, regulated to a thin film by the doctor blade 12 made of stainless steel, to a developing area, which faces the photoconductor 1, to develop a latent image on the photoconductor 1 as toner image.

The developing roller 5 may have a surface, which may have V-shaped groove or sandblasted surface, for example.

The developing roller 5 may be made of metal pipe such as aluminum or SUS (stainless steel) pipe having a given diameter (e.g., 25 mm), for example.

The developing roller 5 may have a given gap (e.g., 0.3 mm) with the doctor blade 12 and photoconductor 1.

After developing process, developer may be recovered and transported in the recovery compartment 7, and such recovered developer may be transported to the agitation compartment 10 from the recovery compartment 7 through the opening port of the first separation wall 133.

Although not shown in FIG. 2, the developing unit 4 may have a toner supply port, provided over the agitation compartment 10 and near the opening port of the first separation wall 133, to refill fresh toner to the agitation compartment 10.

Hereinafter, a circulation of developer in the above-mentioned compartments in the developing unit 4 is explained.

Figure 3:
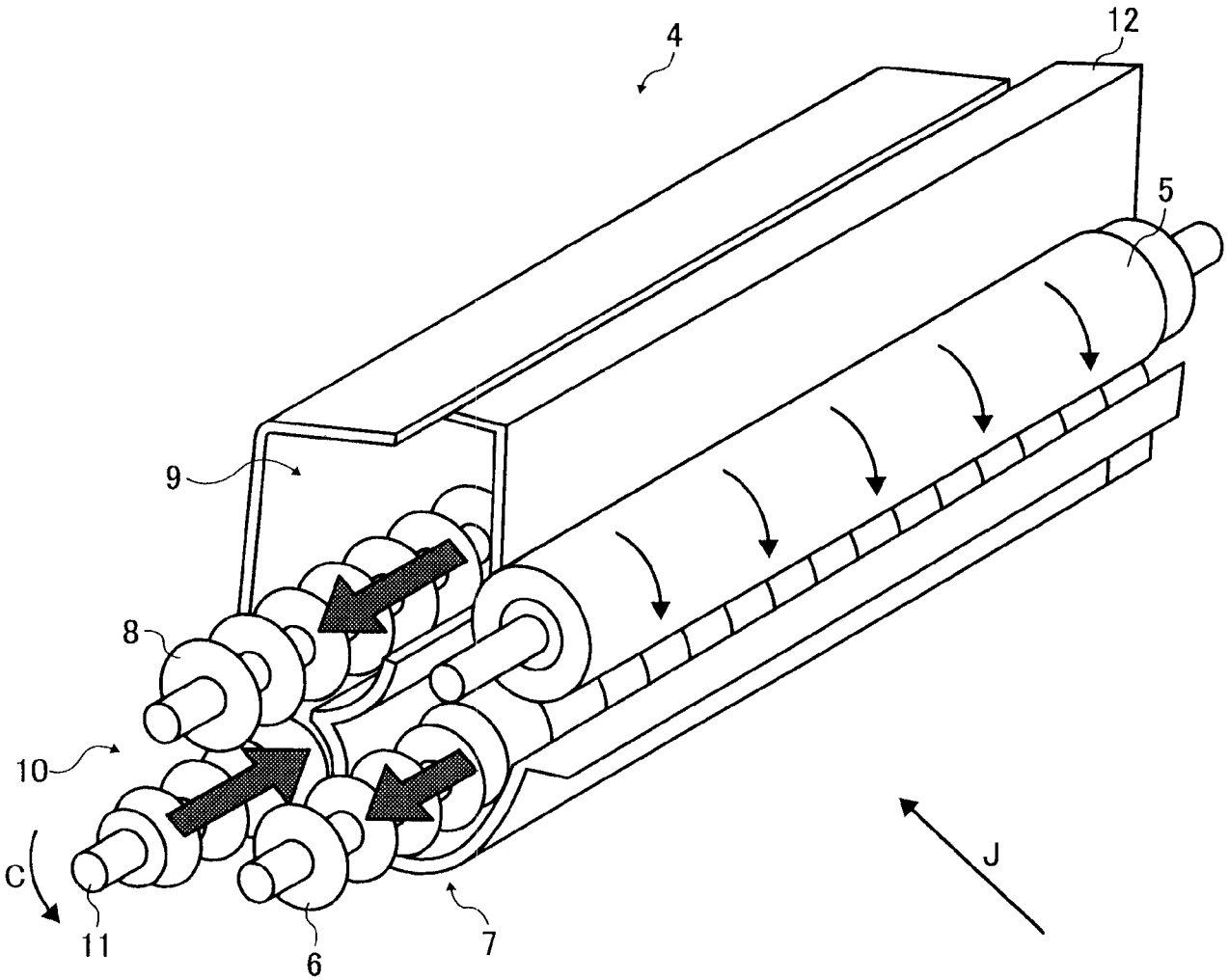
FIG. 3 is a perspective cross-sectional view of developer flowing pattern in a developing unit.

FIG. 3 is a perspective view of the developing unit 4, in which some part is omitted to show an internal configuration of the developing unit 4. The arrows shown in FIG. 3 may show a moving direction of developer in the developing unit 4.

Figure 4:
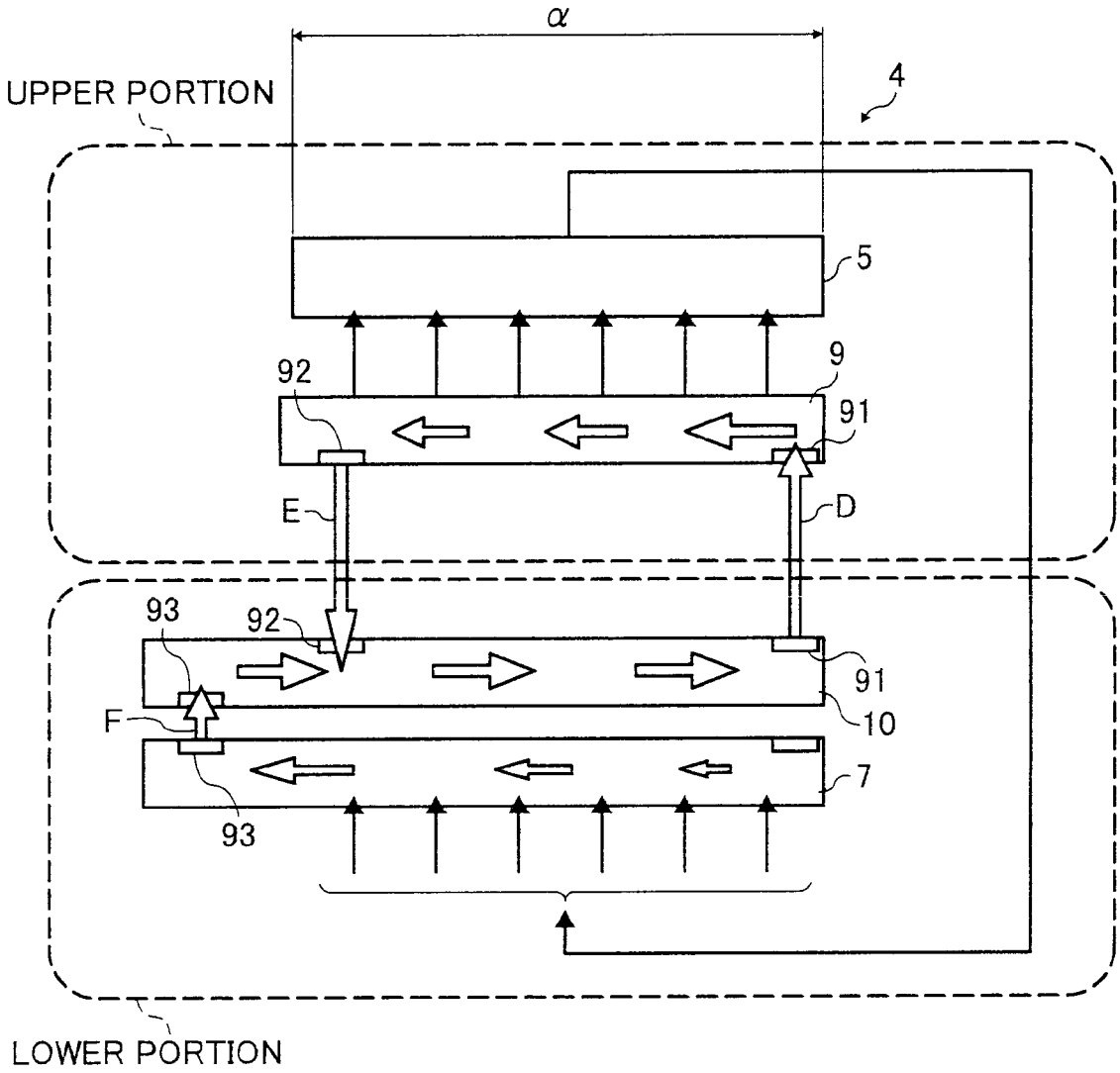
FIG. 4 is a schematic view of a developing unit for explaining a flow pattern of developer.

FIG. 4 shows a schematic view of flow pattern of developer in the developing unit 4. The arrows in FIG. 4 similarly show a moving direction of developer in the developing unit 4.

Developer may be supplied from the agitation compartment 10 to the supplying compartment 9 having the supply screw 8.

The supply screw 8 may transport developer to a downstream side of transport direction of the supplying compartment 9 and supply the developer to the developing roller 5 during such transportation.

Some of developer in the supplying compartment 9, which may not be supplied to the developing roller 5 (i.e., developer not used for developing process) may be transported to a downstream end of transport direction in the supplying compartment 9. Such un-used developer may be termed as excess developer, hereinafter.

Such excess developer may be transported to the agitation compartment 10 through a second opening port 92 of the first separation wall 133 (refer to an arrow E in FIG. 4).

The recovery compartment 7 having the recovery screw 6 may be used to recover the developer from the developing roller 5. The recovery screw 6 may transport recovered developer to the downstream end of transport direction in the recovery compartment 7. Then, such recovered developer may be transported to the agitation compartment 10 through a third opening port 93 of the second separation wall 134 (refer to an arrow F in FIG. 4).

In the agitation compartment 10, the above-mentioned excess developer and recovered developer may be agitated with the agitation screw 11.

The agitation screw 11 may transport the developer to the downstream end of transport direction in the agitation compartment 10, and then the developer may be transported to the supplying compartment 9 through a first opening port 91 of the first separation wall 133 (see arrow D in FIG. 4).

In the agitation compartment 10, the agitation screw 11 may agitatingly transport the developer, which may include the recovered developer, the excess developer, and fresh toner refilled to the agitation compartment 10, as required.

The agitation screw 11 may transport the developer in a direction, which is opposite to a transport direction in the recovery compartment 7 and supplying compartment 9.

Developer transported to a downstream end of the agitation compartment 10 may be transported to an upstream end of the supplying compartment 9 because the downstream end of the agitation compartment 10 is communicated to the upstream end of the supplying compartment 9 through the first opening port 91 of the first separation wall 133 (refer to an arrow D in FIG. 4).

Although not shown, a toner concentration sensor (not shown) may be provided under the agitation compartment 10. A toner refilling unit (not shown) may be activated based on a signal from the toner concentration sensor to refill toner from a toner container (not shown) to the developing unit 4.

As shown in FIG. 4, the developing unit 4 may include the supplying compartment 9 and recovery compartment 7.

Developer may be supplied to the developing roller 5 from the supplying compartment 9, and used developer may be recovered from the developing roller 5 in the recovery compartment 7.

Accordingly, a supply of developer and recovery of developer may be conducted in different compartments, by which used developer, which is used for developing process, may not be mixed in the supplying compartment 9.

Accordingly, toner concentration in developer at the downstream side of transport direction in the supplying compartment 9 may not decrease. Instead, toner concentration in developer in the supplying compartment 9 may be maintained at a preferable level from the upstream side to downstream side of transport direction in the supplying compartment 9.

Further, as shown in FIG. 4, the developing unit 4 may include the recovery compartment 7 and agitation compartment 10.

Accordingly, a recovery of developer and agitation of developer may be conducted in different compartments, by which used developer, which is used for developing process, may not be mixed in the agitation compartment 10 directly.

Accordingly, the developer agitated effectively in the agitation compartment 10 may be transported to the supplying compartment 9, by which such effectively agitated developer can be transported to the supplying compartment 9.

As such, toner concentration in developer in the supplying compartment 9 may be maintained at a preferable level at any points in the supplying compartment 9, and developer in the supplying compartment 9 may be effectively agitated, an image concentration developed by such developer in the supplying compartment 9 may be maintained at a preferable level.

As shown in FIG. 4, the developer may be moved from a lower side to an upper side in the developing unit 4 in a direction shown by an arrow D.

The arrow D may show a movement direction of developer from a lower side to an upper side in the developing unit 4, in which developer may be pushed up by a rotation of the agitation screw 11 and may be piled up so that developer can be transported to the supplying compartment 9.

Such movement may cause a stress to developer, by which a lifetime of developer may become shorter.

When developer may be moved from the lower side to upper side, developer may receive a stress effect, by which the developer may be degraded. For example, carriers in the developer may loose its surface layer, or component of toners may adhere on carriers. Such degraded developer may degrade image quality to be produced on a recording sheet.

Accordingly, by decreasing a stress level to developer when developer is moved in a direction shown by an arrow D, a lifetime of developer may be enhanced. Such lifetime enhanced developer may be preferably used in the developing unit 4 to stably produce an image having higher image quality such as no image-concentration variation.

As shown in FIG. 2, in the developing unit 4, the supplying compartment 9 may be positioned over the agitation compartment 10 while a position of the supplying compartment 9 may be deviated in a horizontal direction from a vertical line of the agitation compartment 10. In other words, the supplying compartment 9 may be positioned over the agitation compartment 10 diagonally.

Such diagonally positioned agitation compartment 10 and supplying compartment 9 may preferably reduce a stress associated to a movement of developer in a direction shown by an arrow D in FIG. 4.

If the supplying compartment 9 is positioned over the agitation compartment 10 in a vertically upward direction, developer may need to be pushed up in a vertical direction from the agitation compartment 10 to the supplying compartment 9, which may cause a relatively greater stress to developer.

Further, in the developing unit 4, because the supplying compartment 9 and agitation compartment 10 are positioned in a diagonal position each other as shown in FIG. 2, an upper wall face of the agitation compartment 10 may be positioned higher than a lower wall face of the supplying compartment 9.

Developer may receive a greater stress when the developer is pushed up from the agitation compartment 10 to the supplying compartment 9 in a vertically upward direction by a pressure effect of the agitation screw 11 because such developer may need to be pushed up against the force of gravity.

In an example embodiment, the upper wall face of the agitation compartment 10 may be positioned higher than the lower wall face of the supplying compartment 9 as shown in FIG. 2.

Accordingly, developer existing at a highest point of the agitation compartment 10 may flow down to a lowest point of the supplying compartment 9 with the force of gravity, by which the developer may move in a direction shown by an arrow D in FIG. 4 with preferably reduced stress condition.

Further, the agitation screw 11 may be provided with a fin member on its shaft. Specifically, such fin member may be provided on a shaft portion facing the first opening port 91 between the agitation compartment 10 and supplying compartment 9.

Such fin member may include a plate-like member having one side extending parallel to the axial direction of the agitation screw 11, and another side extending vertical to the axial direction of the agitation screw 11. Such fin member may stir developer to efficiently move developer from the agitation compartment 10 to supplying compartment 9.

Further, in the developing unit 4, a center-to-center distance "A" of the developing roller 5 and supplying compartment 9 may be set smaller than a center-to-center distance "B" of the developing roller 5 and agitation compartment 10 as shown in FIG. 2 (i.e., A<B).

With such positioning, developer may be supplied to the developing roller 5 from the supplying compartment 9 easily, and a miniaturization of the developing unit 4 may be achieved.

Further, the agitation screw 11 may rotate in a counter-clockwise direction in FIG. 2 (i.e., a direction of arrow C). Such agitation screw 11 may have a given shape, which can effectively push up developer to the supplying compartment 9. Accordingly, developer may be efficiently pushed up with less stress to developer.

Hereinafter, the supply screw 8 and agitation screw 11 used as developer transport member is explained.

A conventional developing unit may set a same condition for a supply screw, a recovery screw, and an agitation screw. For example, a supply screw, recovery screw, and agitation screw may have a same screw pitch (e.g., 25 mm), a same outer diameter, and a same rotational speed, in which one screw is winded on a shaft in a single manner.

On one hand, the developing unit 4 according to an example embodiment may set different settings for the supply screw 8, the recovery screw 6, and agitation screw 11.

For example, the supply screw 8 may have a screw pitch of 50 mm, and the recovery screw 6 and agitation screw 11 may have a screw pitch of 25 mm. Further, the supply screw 8 may have a double-winded screw, winding screws on a shaft in a double manner, and the recovery screw 6 and agitation screw 11 may have a singly-winded screw, winding one screw on a shaft in a single manner, for example. Further, the supply screw 8, recovery screw 6, and agitation screw 11 may have a same screw diameter of 22 mm, for example. Further, the supply screw 8, recovery screw 6, and agitation screw 11 may have a same rotational speed of about 700 rpm (rotation per minute), for example.

Figure 5:
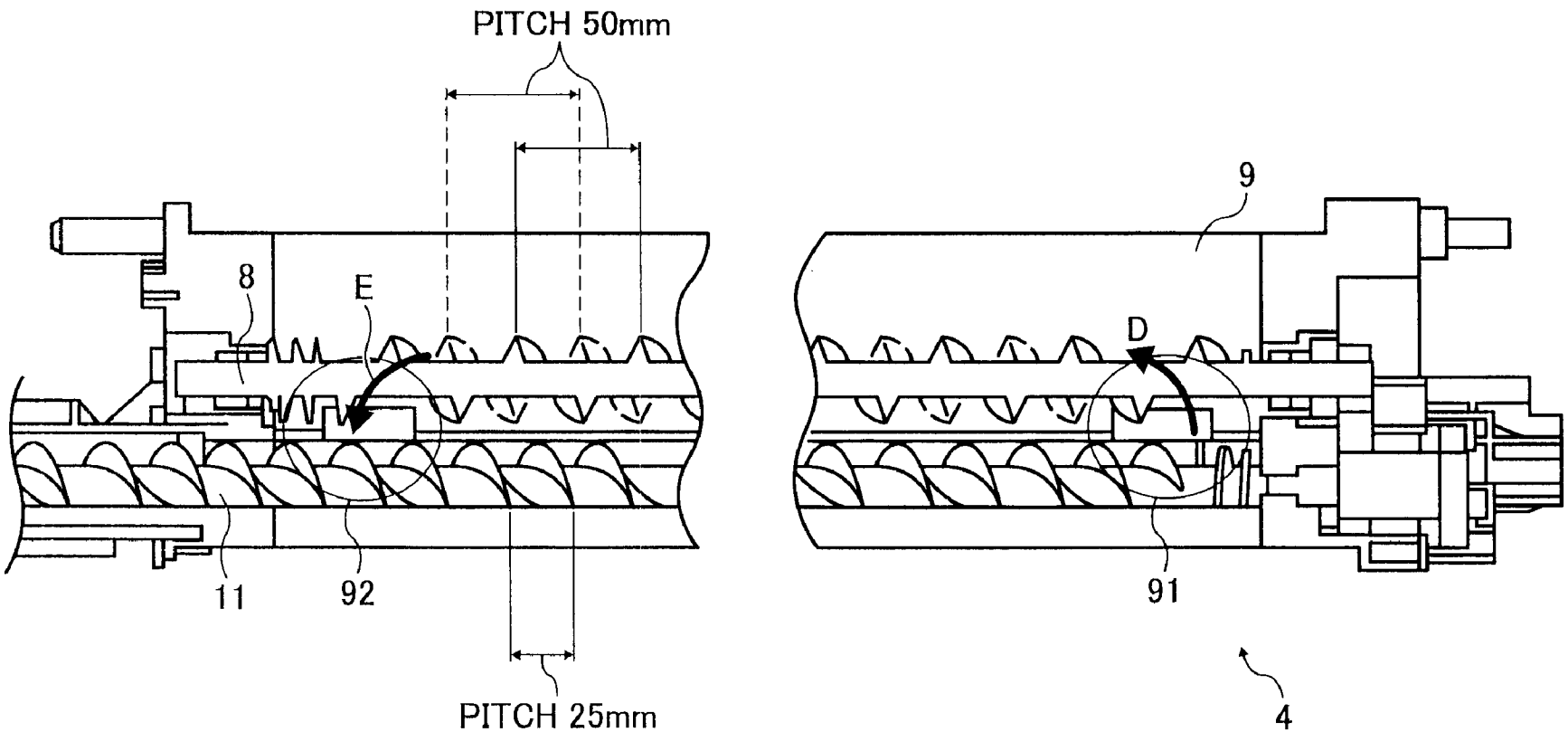
FIG. 5 is a cross-sectional view of a developing unit for explaining a screw pitch of screws.

FIG. 5 shows a cross sectional view of the supply screw 8 in the developing unit 4, which is viewed from a direction of arrow J in FIG. 3. FIG. 5 shows a screw pitch of the supply screw 8 and agitation screw 11.

As such, each screw in the developing unit 4 may have different screw conditions, which is explained as below.

To obtain a developer transport force for transporting sufficient amount of developer from the downstream end of the agitation compartment 10 to the upstream end of the supplying compartment 9, a screw pitch of agitation screw 11 may need to be set to a relatively smaller pitch to elevate screw vanes from the shaft surface of the agitation screw 11. Such elevated screw vanes may effectively push up developer.

If a screw pitch of agitation screw 11 may be set to a relatively greater pitch, developer to be supplied to the upstream end of the compartment 9 from the downstream end of the agitation compartment 10 in a direction shown by an arrow D in FIG. 4 may decrease.

If a screw pitch of agitation screw 11 may be set to a relatively greater pitch, screw vanes may extend from the shaft surface with a smaller acute angle. Such screw vanes may not exercise an effective developer transport force to push up developer to the supplying compartment 9 with a rotation of the agitation screw 11. Accordingly, an amount of developer to be transported to the supplying compartment 9 may decrease.

Further, the supply screw 8 in the supplying compartment 9 may have a screw pitch, which may be set greater than the screw pitch of the agitation screw 11 to increase a developer transporting speed in the supplying compartment 9.

Specifically, the supply screw 8 may have a screw pitch of 50 mm, which is greater than the screw pitch of 25 mm of the agitation screw 11, for example.

Such supply screw 8 may preferably transport developer from the upstream side to downstream side in the supplying compartment 9 with a given developer transporting speed, which may substantially match to a developer supplying speed to the developing roller 5, by which developer can be distributed in the supplying compartment 9 evenly and a shortage of developer at the downstream side of the supplying compartment 9 can be suppressed.

As one comparison example, a screw pitch of the agitation screw 11 was set to 50 mm, which is a same screw pitch of the supply screw 8. In this case, an amount of developer transported to the supplying compartment 9 from the agitation compartment 10 was decreased. It was confirmed that the agitation screw 11 did not effectively exercise developer transport force if the agitation screw 11 has a screw pitch of 50 mm because the screw vanes may extend from the shaft surface with a too smaller acute angle.

As such, a screw pitch of each screw in the developing unit 4 may need to be set to a given value depending on a function of each screw.

For example, a screw pitch of each screw in the developing unit 4 may be set to a given value so that the developer can be effectively transported to the supplying compartment 9 from the agitation compartment 10 and developer can be transported in the supplying compartment 9 with a faster developer transporting speed to evenly distribute the developer in the supplying compartment 9.

Accordingly, in an example embodiment, the agitation screw 11 may have a relatively shorter screw pitch of 25 mm to exercise a developer transport force effectively, and the supply screw 8 may have a relatively greater screw pitch of 50 mm to have an effective developer transporting speed.

Further, the supply screw 8 has a double-winded screw on a shaft.

In general, the greater the number of screw winding, the greater the developer transport force by the screw, by which an amount of developer transported along the axial direction per unit time may increase.

Accordingly, the supply screw 8 having a relatively greater number of screw winding can effectively transport developer in the supplying compartment 9, by which a shortage of developer at the downstream side of the supplying compartment 9 may be suppressed. However, if the screw winding number of screw may become too great, the developer transporting speed may inadvertently become smaller.

With such configuration for a developer agitation transporter (e.g., agitation screw 11) and developer supply transporter (e.g., supply screw 8), an image forming apparatus can preferably conduct an image forming operation at higher speed, and durability, miniaturization of the developing unit 4 can be enhanced. Further, developer can be effectively transported to the downstream side of the developer supply transporter (e.g., supply screw 8).

Hereinafter, a positional relationship of screws in the axial direction is explained.

Figure 6:
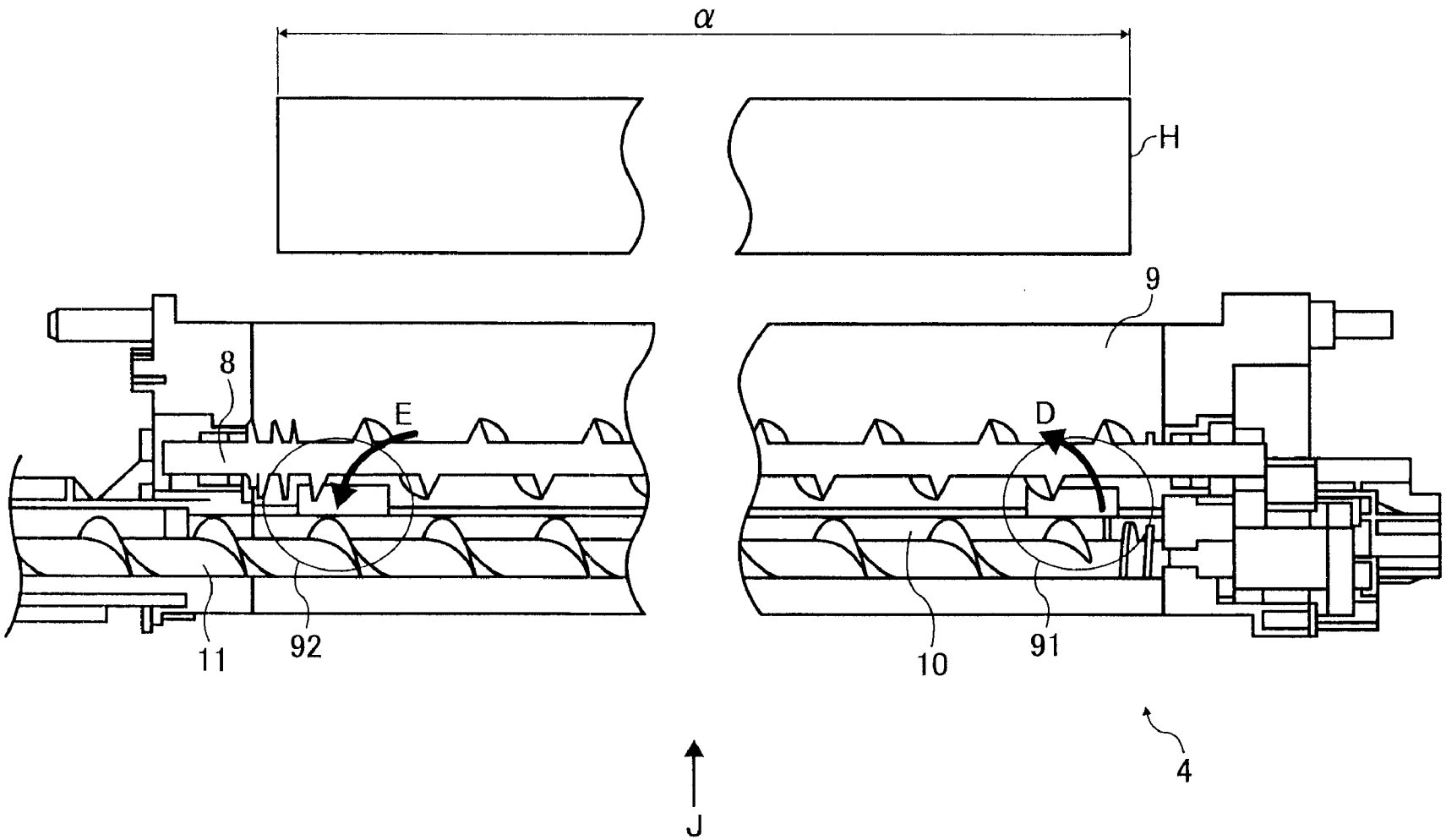
FIG. 6 is a cross-sectional view of a developing unit for explaining a screw pitch of screws.

FIG. 6 shows a cross sectional view of the developing supply screw 8 and developing roller 5, which is viewed from a direction of arrow J in FIG. 3.

In FIG. 6, a developing area H may correspond to a developing area of the developing roller 5, in which the developing roller 5 may supply toner to the photoconductor 1.

The developing area H of the developing roller 5 may have a developing area width α in an axial direction of the developing roller 5.

As shown in FIGS. 4 and 6, the developing unit 4 may include the first opening port 91 and the second opening port 92.

As shown in FIG. 4, developer may be pushed up from the agitation compartment 10 to the supplying compartment 9 through the first opening port 91, and developer may fall from the supplying compartment 9 to the agitation compartment 10 through the second opening port 92.

As shown in FIGS. 4 and 6, the first opening port 91 and second opening port 92 may be provided in an area corresponding to the developing area width α.

Figure 7:
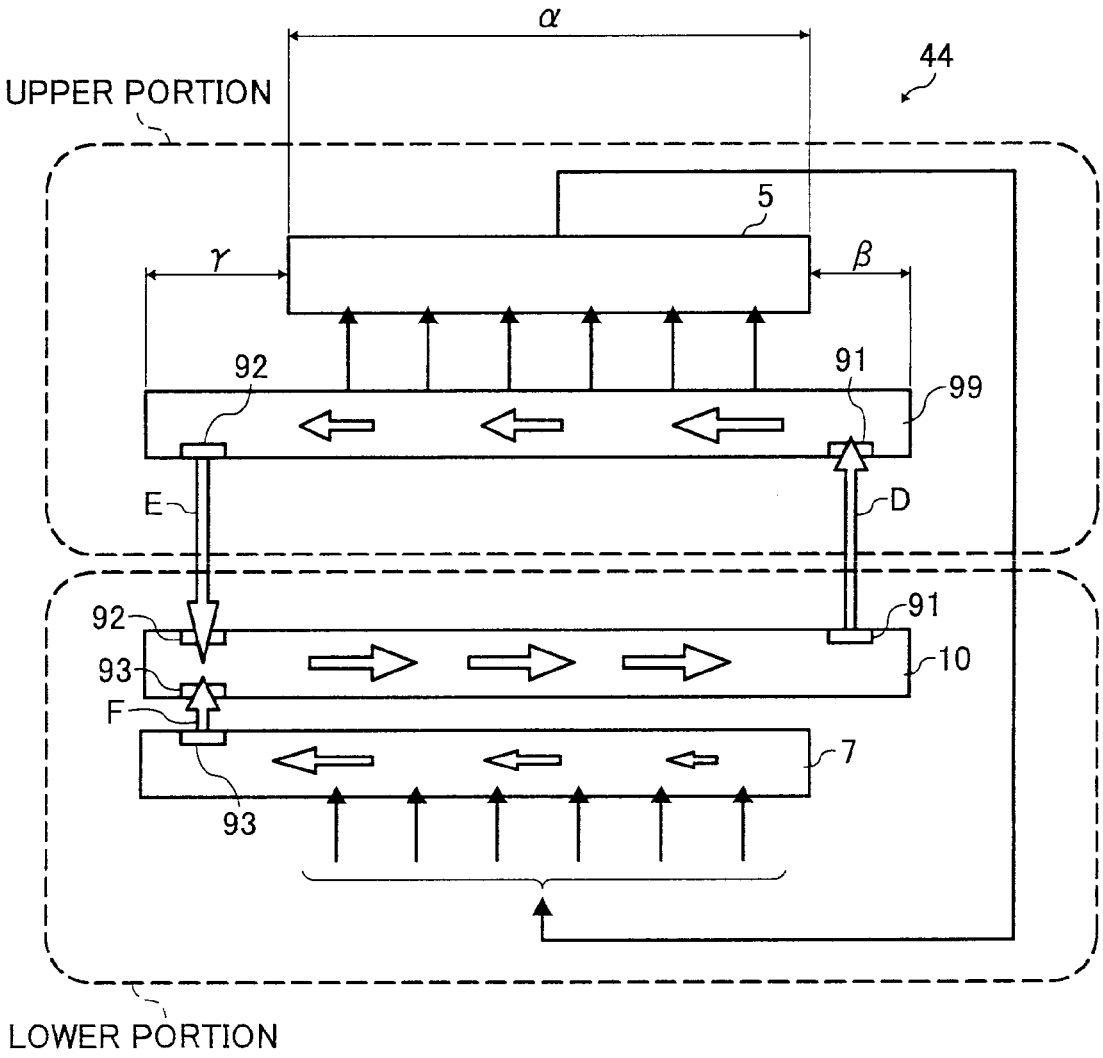
FIG. 7 is a schematic view of a comparison developing unit for explaining a flow pattern of developer.

FIG. 7 shows a schematic view of flow pattern of developer in a conventional developing unit 44.

As shown in FIG. 7, the conventional developing unit 44 may have the first opening port 91 and second opening port 92 at an area, which is outside of the developing area width α.

Because the first opening port 91 is provided outside the developing area width α, the supplying compartment 9 may have an end portion β at the upstream side of a supplying compartment 99, by which a length of the supplying compartment 99 may become longer than a length of developing roller 5 at the upstream side of the supplying compartment 99 for the end portion β.

Further, because the second opening port 91 is provided outside the developing area width α, the supplying compartment 99 may have an end portion γ at the downstream side of the supplying compartment 99, by which a length of the supplying compartment 99 may become longer than a length of developing roller 5 at the downstream side of the supplying compartment 99 for the end portion γ.

On one hand, the developing unit 4 shown in FIG. 4 may have a configuration as below.

Because the first opening port 91 may be provided within the developing area width α as shown in FIG. 4, a length of the supplying compartment 9 may be set shorter than the supplying compartment 99 of the conventional developing unit 44 for the end portion β at the upstream side of the supplying compartment 9.

Further, because the second opening port 92 may be provided within the developing area width α as shown in FIG. 4, a length of the supplying compartment 9 may be set shorter than the supplying compartment 99 of the conventional developing unit 44 for the end portion γ at the downstream side of the supplying compartment 9.

As such, because the developing unit 4 according to an example embodiment may have the first opening port 91 and second opening port 92 within the developing area width α, a dimension of upper portion of the developing unit 4 may be set smaller compared to the conventional developing unit 44, which may be preferable for miniaturization of the developing unit 4.

Hereinafter, a toner refilling position for the developing unit 4 is explained with reference to FIG. 8, which is a perspective view of the developing unit 4.

Figure 8:
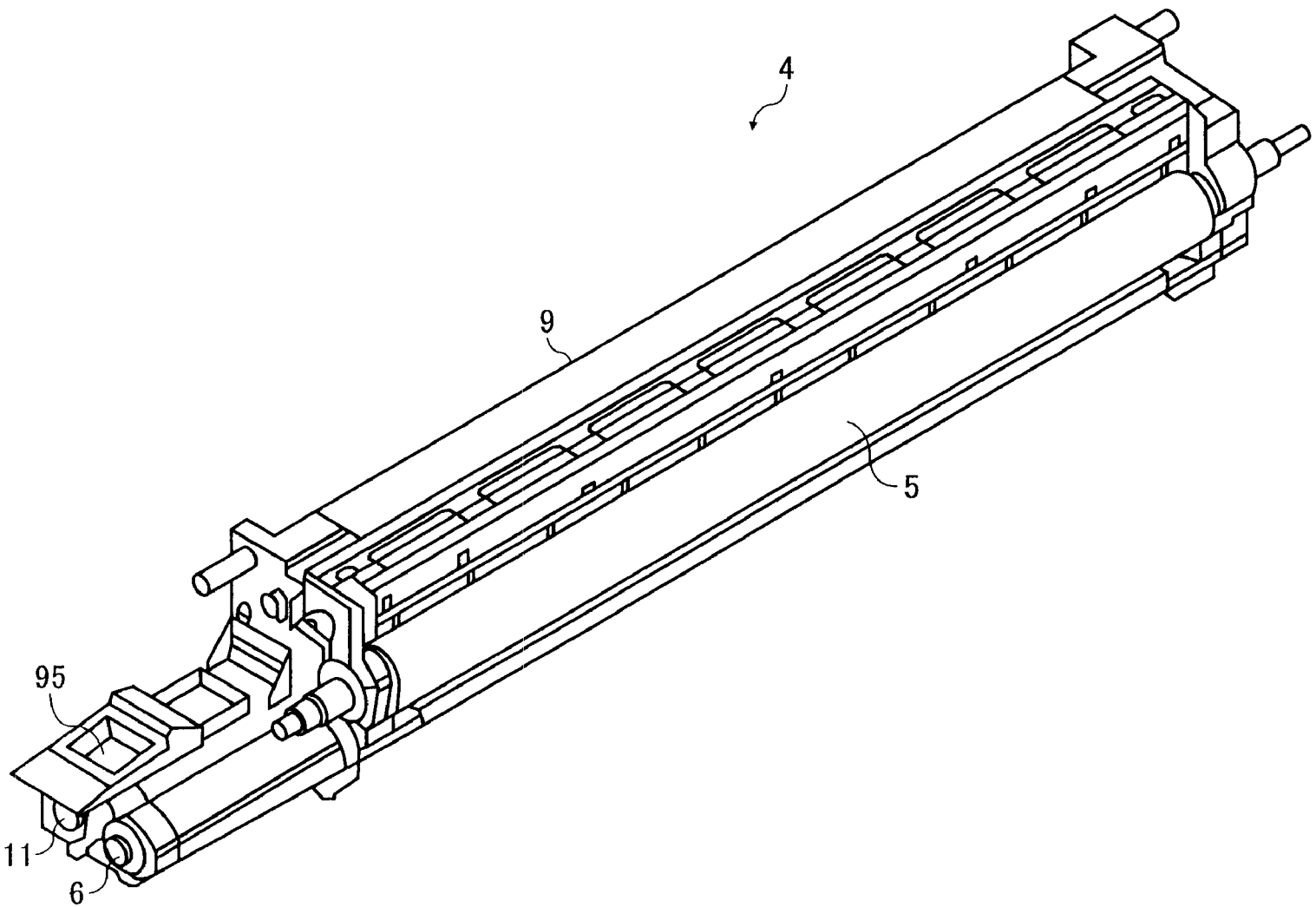
FIG. 8 is another perspective view of a developing unit.

As shown in FIG. 8, a toner refilling port 95 may be provided over an upstream end of the agitation compartment 10. Toners may be refilled to the developing unit 4 through the toner refilling port 95.

Such toner refilling port 95, provided outside of the developing roller 5 in an axial direction of the developing roller 5, may be positioned outside the developing area width α.

Such toner refilling port 95 may be provided at a portion outside the supplying compartment 9 as shown in FIG. 8, wherein such portion may correspond a space, which is used as the end portion γ in the conventional developing unit 44 shown in FIG. 7.

Because the second opening port 92 is provided within the developing area width α of the developing unit 4, the toner refilling port 95 can be provided to a space, which is occupied by the supplying compartment 99 of the conventional developing unit 44 (see FIG. 7), the developing unit 4 can be miniaturized compared to the conventional developing unit 44.

Further, the toner refilling port 95 may be provided at the downstream end of the recovery compartment 7 instead of the upstream end of the agitation compartment 10.

Further, the developing unit 4 may include the third opening port 93 (refer to FIG. 4) between the recovery compartment 7 and agitation compartment 10 to transport developer from the recovery compartment 7 to the agitation compartment 10.

The toner refilling port 95 can be provided over the third opening port 93, as required. A space over the third opening port 93 can be allocated for the developing unit 4 because the second opening port 92 is provided within the developing area width α as above explained. Accordingly, the toner refilling port 95 can be provided to such space, by which the developing unit 4 can be miniaturized compared to the conventional developing unit 44.

Further, if the toner refilling port 95 is provided over the third opening port 93 used for transporting the developer from the recovery compartment 7 to the agitation compartment 10, refilled fresh toner can be efficiently and effectively mixed with the developer at the third opening port 93, by which developer may be efficiently agitated in the agitation compartment 10.

Further, the developing unit 4 according to an example embodiment may include the supplying compartment 9, which is provided over the agitation compartment 10 and recovery compartment 7.

In addition to such configuration, the developing unit 4 according to an example embodiment may configure the supplying compartment 9, the agitation compartment 10, and the recovery compartment 7 in a different configuration, as required while maintaining the above-described features of the developing unit 4.

Hereinafter, a developing unit **4*a* having the supplying compartment 9, agitation compartment 10, and recovery compartment 7 at a substantially identical height is explained as a modified configuration of the developing unit 4**.

Figure 9:
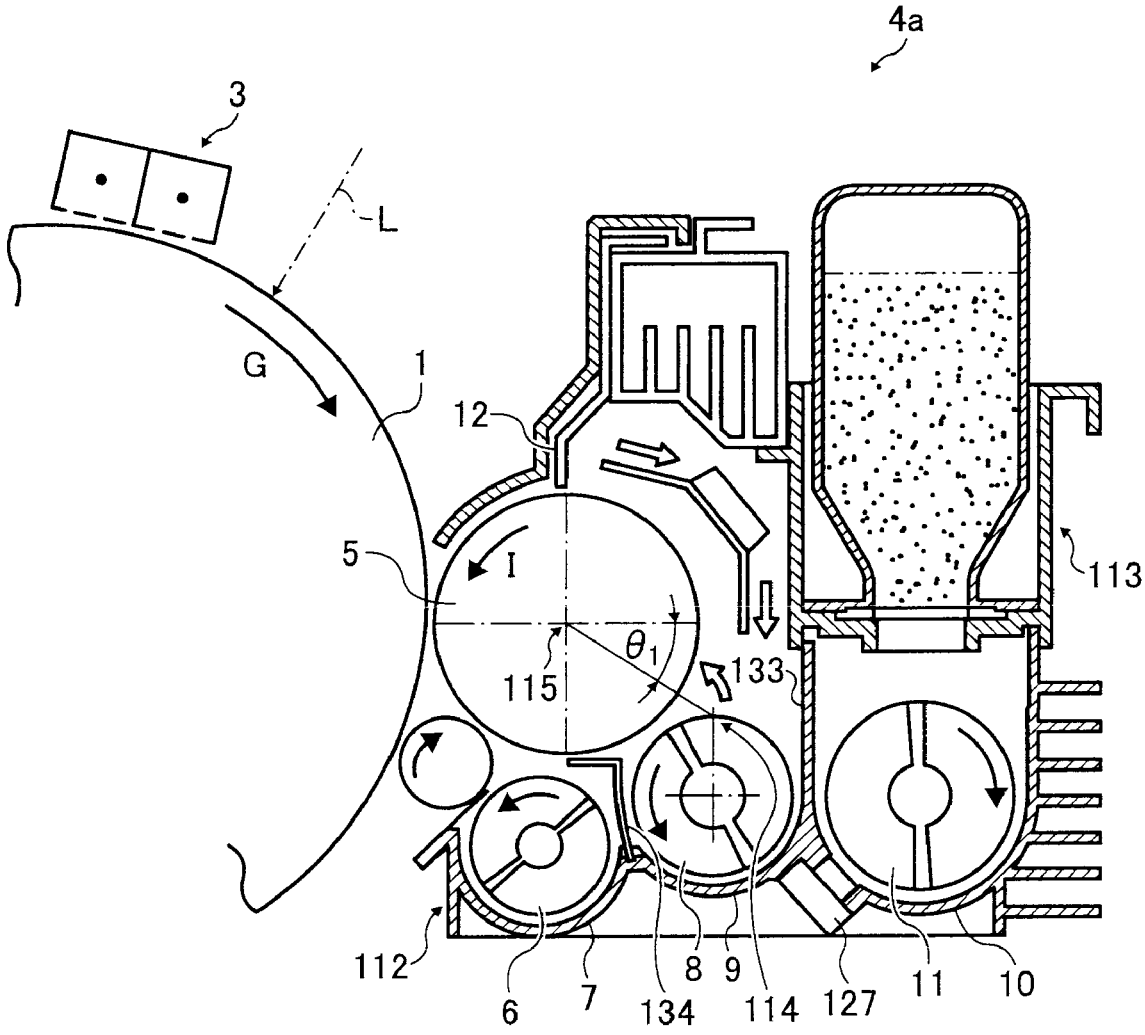
FIG. 9 is a cross-sectional view of another developing unit according to an example embodiment.

FIG. 9 is a schematic cross sectional view of the developing unit **4*a*. The developing unit 4*a* may have parts similarly used in the developing unit 4**, which have similar reference numbers.

As shown in FIG. 9, the photoconductor 1 may rotate in a direction shown by an arrow G, and a scorotron charger 3 may charge a surface of the photoconductor 1. A laser beam L emitted from a writing unit (not shown) may irradiate the charged surface of the photoconductor 1 to form an electrostatic latent image on the photoconductor 1. The developing unit **4*a* may supply toners to such latent image to develop a toner image on the photoconductor 1**.

The developing unit **4*a* may include the developing roller 5, which may rotate in a direction shown by an arrow I and supply toner to the latent image formed on the photoconductor 1 to develop a toner image on the photoconductor 1**.

Further, the developing unit **4*a* may include the supply screw 8, which may transport developer in one direction while supplying the developer to the developing roller 5**.

Further, the developing unit 4*a* may include the doctor blade 12 to regulate a thickness of developer on the developing roller 5.

Further, the developing unit 4*a* may include the recovery screw 6, which may recover the developer used for developing process on a developing area of the developing roller 5, and transport the recovered developer in one direction, which may be a same transportation direction of supply screw 8.

Further, the developing unit 4*a* may include the supplying compartment 9 having the supply screw 8 and the recovery compartment 7 having the recovery screw 6 side-by-side under the developing roller 5 as shown in FIG. 9. The second separation wall 134 may separate the supplying compartment 9 and recovery compartment 7 as shown in FIG. 9.

Further, the developing unit 4*a* may include the agitation compartment 10 provided next to the supplying compartment 9.

Accordingly, the recovery compartment 7, the supplying compartment 9, and the agitation compartment 10 may be provided in the developing unit 4*a* side-by-side each other as shown in FIG. 9.

The agitation compartment 10 may include the agitation screw 11, which may agitatingly transport developer in one direction, which may be opposite to a transportation direction of supply screw 8.

The first separation wall 133 may separate the supplying compartment 9 and agitation compartment 10.

Although not shown, the first separation wall 133 may have an opening port on both end of the first separation wall 133, through which the supplying compartment 9 and agitation compartment 10 may be communicated each other.

Excess Developer, which is transported in the supplying compartment 9 but not used for developing process, and recovered developer, which is recovered in the recovery compartment 7, may be transported to the agitation compartment 10.

In the agitation compartment 10, the agitation screw 11 may agitate such excess developer and recovered developer and transport the agitated developer to the downstream side of the agitation compartment 10.

Then, through the opening port of the first separation wall 133, the developer may be transported from the agitation compartment 10 to the supplying compartment 9.

The second separation wall 134 may have one opening port on its end portion, through which the supplying compartment 9 and recovery compartment 7 may be communicated each other.

Accordingly, although not shown, a downstream end of the recovery compartment 7, a downstream end of the supplying compartment 9, and an upstream end of the agitation compartment 10 may be communicated each other.

The recovered developer in the recovery compartment 7 may be transported to the downstream side of the recovery compartment 7, and further transported to the supplying compartment 9.

Further, the above-mentioned recovered developer and excess developer may be transported to the agitation compartment 10 from the supplying compartment 9.

In the agitation compartment 10, the agitation screw 11 may agitatingly transport the recovered developer, excess developer, and refilled toner in one direction in the agitation compartment 10, which is opposite to a transport direction in the recovery compartment 7 and supplying compartment 9.

Such agitated developer may be transported to the supplying compartment 9 from the agitation compartment 10, wherein the downstream end of the agitation compartment 10 is communicated to the upstream end of the supplying compartment 9.

Further, the developing unit 4 may include a toner concentration sensor 127 under the agitation compartment 10, a toner refilling controller (not shown), and a toner bottle. The toner refilling controller may refill toner to the fixing unit 4 from the toner bottle based on a signal from the toner concentration sensor 127.

The developing unit 4 may include a lower casing 112 and an upper casing 113, which may be separable each other.

The first separation wall 133 may be included in the lower casing 112, and the second separation wall 134 may be included in the lower casing 112, for example.

Further, the above-mentioned toner refilling controller may include a mohno pump, for example, which may be preferably used because a configuration using mohno pump may have less restriction where to place the toner bottle in an image forming apparatus. In other words, a layout in such image forming apparatus may be designed with less restriction, which is preferable for designing an image forming apparatus. Further such configuration can refill toner at a given timing to the developing unit 4*a*, by which the developing unit 4*a* may not need a greater toner storage space in the developing unit 4*a*, and the developing unit 4*a* may be preferably miniaturized.

As shown in FIG. 9, a screw top point 114 of the supply screw 8 may be set lower than a rotation center 115 of the developing roller 5. The screw top point 114 is the highest point of the supply screw 8.

As shown in FIG. 9, a straight line extending from the rotation center 115 to the screw top point 114 and a straight line extending from the rotation center 115 in a horizontal direction may have an angle θ1, which may be set to 30 degrees, for example. Such angle θ1 may be determined with factors such as diameter of the supply screw 8.

In an example embodiment, the angle θ1 may be set to from 10 degrees to 40 degrees to effectively miniaturize the developing unit 4*a*.

The developing roller 5 may include magnetic poles therein, by which the developer including magnetic carriers may be attracted to the developing roller 5.

If a conventionally prepared screw is used in the developing unit 4*a*, drawbacks may likely to occur when an image forming apparatus may conduct image forming operations with a higher speed. For example, a developer transporting speed in the supplying compartment 9 may not be matched to a developer supplying speed to the developing roller 5, by which a shortage of developer may occur at the downstream side of the supplying compartment 9 and an toner image may not be effectively developed on a corresponding developing area on the developing roller 5.

In the developing unit 4*a*, the agitation screw 11 may have a relatively shorter screw pitch such as 25 mm to effectively exercise a developer transport force, and the supply screw 8 may have a relatively greater screw pitch such as 50 mm to have an effective developer transporting speed as similar to the above-explained developing unit 4.

With such setting for the agitation screw 11 and supply screw 8, the developing unit 4*a* may enhance its durability and miniaturization, and a shortage of developer may not occur at the downstream side of the supplying compartment 9 even if an image forming apparatus may conduct image forming operations with a higher speed.

In a conventional developing unit having an agitation compartment, a supplying compartment, and a recovery compartment provided side-by-side at a substantially similar height, an opening port for transporting developer from the agitation compartment to the supplying compartment may be provided outside of a developing area width of developing roller. Accordingly, the agitation compartment and supplying compartment may protrude from an end of developing roller and recovery compartment.

In the developing unit 4*a,* such opening port may be provided within a developing area width of the developing roller 5, by which the agitation compartment 10 and supplying compartment 9 may not substantially protrude from an end of developing roller 5 and recovery compartment 7, and the developing unit 4*a* may be preferably miniaturized.

Further, because the agitation compartment 10, supplying compartment 9, and recovery compartment 7 may be provided side-by-side at a substantially similar height, developer may not be pushed up in an upward direction, by which the developer may not receive a greater stress.

Accordingly, a degradation of developer may be suppressed and image quality may be maintained at a higher level for an image forming apparatus using the developing unit 4*a*.

In an example embodiment, the agitation screw 11 may have a relatively shorter screw pitch to obtain a given developer transport force, which may effectively transport developer from the downstream end of the agitation compartment 10 to the upstream end of the supplying compartment 9.

Further, the supply screw 8 may have a relatively greater screw pitch compared to the screw pitch of the agitation screw 11 to enhance a developer transporting speed in the supplying compartment 9.

Such supply screw 8 having a relatively greater screw pitch may transport the developer at a faster developer transporting speed, which may match to a developer supplying speed to the develop roller 5, by which the developer may be evenly distributed in the supplying compartment 9 and shortage of developer at the downstream side of supplying compartment 9 may be suppressed.

With such setting for the agitation screw 11 and supply screw 8, the developing unit according to an example embodiment may be enhanced its durability and miniaturization, and a shortage of developer may not occur at the downstream side of the supplying compartment 9 even if an image forming apparatus may conduct image forming operations with a higher speed.

Further, the supply screw 8 may have a relatively greater number of screw winding compared to the agitation screw 11, by which the supply screw 8 can push the developer with a greater force, and an amount of developer to be transported in an axial direction of the supply screw 8 per unit time can be increased. Accordingly, a shortage of developer at the downstream side of the supplying compartment 9 can be suppressed effectively.

Further, the supply screw 8 may have a screw pitch, which is greater than a screw pitch of the agitation screw 11 by two times or more so that the supply screw 8 can exercise a developer transporting speed, which can be matched for image forming operations at a higher speed.

Further, the supply screw 8 may have a screw winding number, which is at least twice a screw winding number of the agitation screw 11, so that the supply screw 8 can exercise a developer transporting speed, which can be matched for image forming operations at a higher speed.

Further, the supply screw 8 and the agitation screw 11 may have a substantially identical outer diameter, by which a developing unit may be miniaturized.

Further, the developing unit 4 may be integrated with at least one of a photoconductor, a charging unit, and a cleaning unit as a process cartridge, by which a maintenance-ability of image forming apparatus may be enhanced.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2006-219995 filed on Aug. 11, 2006 in the Japan Patent Office, the entire contents of which is hereby incorporated by reference herein.

What is claimed is:

1. A developing unit, comprising:

a developer carrying member configured to develop a latent image formed on an image carrier with a two-component developer having toner and magnetic carrier by supplying toner to a surface of the image carrier;

a supplying compartment having a developer supplying transporter configured to supply the two-component developer to the developer carrying member while transporting the two-component developer in an axial direction of the developer carrying member;

a recovery compartment having a developer recovery transporter configured to transport the two-component developer recovered from the developer carrying member in an axial direction of the developer recovery transporter, the developer recovery transporter transporting the recovered developer in a same direction of the developer supplying transporter; and an agitation compartment having a developer agitation transporter configured to agitate excess developer not used for a developing process and transported to a downstream side in the supplying compartment and transported to the agitation compartment from the supplying compartment as well as the recovered developer transported to the agitation compartment from the recovery compartment, the developer agitation transporter transporting the agitated excess developer and recovered developer in an axial direction of the developer agitation transporter in an opposite direction of the developer supplying transporter, the agitated excess developer and recovered developer to be transported to the supplying compartment, wherein the recovery compartment, the supplying compartment, and the agitation compartment are each separated from one another by one or more separation members and toner is refilled to a developer transport route formed of the recovery compartment, the supplying compartment, and the agitation compartment, wherein the developer agitation transporter includes a first screw having a given screw pitch to transport a given amount developer to an upstream end of the supplying compartment from a downstream end of the agitation compartment, wherein the developer supplying transporter includes a second screw having a given screw pitch greater than a screw pitch of the first screw.

2. The developing unit according to the claim 1, wherein the developer supplying transporter has a screw winding number greater than a screw winding number of the developer agitation transporter.

3. The developing unit according to the claim 1, wherein the developer supplying transporter has a screw pitch at least twice a screw pitch of the developer agitation transporter.

4. The developing unit according to the claim 2, wherein the developer supplying transporter has a screw winding number greater than a screw winding number of the developer agitation transporter by two times or more.

5. The developing unit according to the claim 1, wherein the developer supplying transporter has a screw outer diameter substantially identical to a screw outer diameter of the developer agitation transporter.

6. A process cartridge detachable from an image forming apparatus, comprising;

the developing unit according to claim 1; and at least one of an image carrier, a charging unit and a cleaning unit, the at least one of the image carrier, charging unit, and cleaning unit integrally assembled with the developing unit.

7. An image forming apparatus, comprising:

an image carrier configured to carry a latent image; and the developing unit according to claim 1 configured to develop the latent image as a toner image.

8. An image forming apparatus, comprising:

a process cartridge detachable from an image forming apparatus, including:

the developing unit according to claim 1; and at least one of an image carrier, a charging unit and a cleaning unit, the at least one of the image carrier, charging unit, and cleaning unit integrally assembled with the developing unit.

9. A developing unit, comprising:

a developer carrying member configured to develop a latent image formed on an image carrier with a developer by supplying toner to a surface of the image carrier;

a supplying area having a developer supplying transporter configured to supply the developer to the developer carrying member while transporting the developer in an axial direction of the developer carrying member;

a recovery area having a developer recovery transporter configured to transport the developer recovered from the developer carrying member in an axial direction of the developer recovery transporter, the developer recovery transporter transporting the recovered developer in a same direction of the developer supplying transporter; and an agitation area having a developer agitation transporter configured to agitate excess developer not used for a developing process and transported to a downstream side in the supplying area and transported to the agitation area from the supplying area as well as the recovered developer transported to the agitation area from the recovery area, the developer agitation transporter transporting the agitated excess developer and recovered developer in an axial direction of the developer agitation transporter in an opposite direction of the developer supplying transporter, the agitated excess developer and recovered developer to be transported to the supplying area, wherein the developer agitation transporter includes a first screw having a given screw pitch to transport a given amount developer to an upstream end of the supplying area from a downstream end of the agitation area, and wherein the developer supplying transporter includes a second screw having a given screw pitch greater than a screw pitch of the first screw.

10. The developing unit according to claim 9, wherein the supplying area is disposed over the recovery area and the agitation area.

11. The developing unit according to the claim 9, wherein the developer supplying transporter has a screw winding number greater than a screw winding number of the developer agitation transporter.

12. The developing unit according to the claim 9, wherein the developer supplying transporter has a screw pitch at least twice a screw pitch of the developer agitation transporter.

13. The developing unit according to the claim 11, wherein the developer supplying transporter has a screw winding number greater than a screw winding number of the developer agitation transporter by two times or more.

14. The developing unit according to the claim 9, wherein the developer supplying transporter has a screw outer diameter substantially identical to a screw outer diameter of the developer agitation transporter.

15. A process cartridge detachable from an image forming apparatus, comprising;

the developing unit according to claim 9; and at least one of an image carrier, a charging unit and a cleaning unit, the at least one of the image carrier, charging unit, and cleaning unit integrally assembled with the developing unit.

16. An image forming apparatus, comprising:

an image carrier configured to carry a latent image; and the developing unit according to claim 9 configured to develop the latent image as a toner image.

17. An image forming apparatus, comprising:

a process cartridge detachable from an image forming apparatus, including:

the developing unit according to claim 9; and at least one of an image carrier, a charging unit and a cleaning unit, the at least one of the image carrier, charging unit, and cleaning unit integrally assembled with the developing unit.

* * * * *